US006582185B2

(12) United States Patent
Lippert et al.

(10) Patent No.: US 6,582,185 B2
(45) Date of Patent: Jun. 24, 2003

(54) SEALING SYSTEM

(75) Inventors: Adam Kenneth Lippert, Tonawanda, NY (US); Scott Alan Spriggs, Williamsville, NY (US); Gregory William Henzler, East Amherst, NY (US); Jeffert John Nowobilski, Orchard Park, NY (US); Robert Leroy Baker, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/951,756

(22) Filed: Sep. 14, 2001

(65) Prior Publication Data

US 2003/0053907 A1 Mar. 20, 2003

(51) Int. Cl.[7] ..... F04D 29/14

(52) U.S. Cl. ..... 415/58.4; 415/112; 415/169.2; 415/230; 415/168.2

(58) Field of Search ..... 415/109, 110, 415/111, 112, 169.1, 169.2, 168.2, 58.4, 230; 417/423, 11

(56) References Cited

U.S. PATENT DOCUMENTS 2,448,717 A * 9/1948 Jeffcock ..... 277/347
3,532,444 A * 10/1970 Strub ..... 277/432
3,645,643 A * 2/1972 King et al. ..... 415/111
4,213,307 A 7/1980 Watson ..... 62/192
6,018,962 A 2/2000 Dewhirst et al. ..... 62/468

* cited by examiner

*Primary Examiner*—Ninh H. Nguyen
(74) *Attorney, Agent, or Firm*—David M. Rosenblum

(57) ABSTRACT

A sealing system to prevent loss of a process fluid from a device having a device opening and a rotating member operable for rotational movement within the device opening. A rotary shaft seal such as a labyrinth seal, seals the rotating member in the device opening to inhibit leakage of process fluid. A chamber is connected to the device to recover leakage of the process fluid that leaks from the rotary shaft seal. A barrier seal is connected to the chamber to inject a barrier fluid under pressure to prevent the escape of process fluid from the chamber. The chamber discharges a mixture of barrier and process fluid to a filter, such as a coalescing filter, to separate the barrier fluid from the process fluid. Barrier fluid vapor and water vapor traps can also be used for purification purposes. The barrier fluid is recovered and recycled back to the barrier seal. The process fluid is returned to the device.

11 Claims, 1 Drawing Sheet

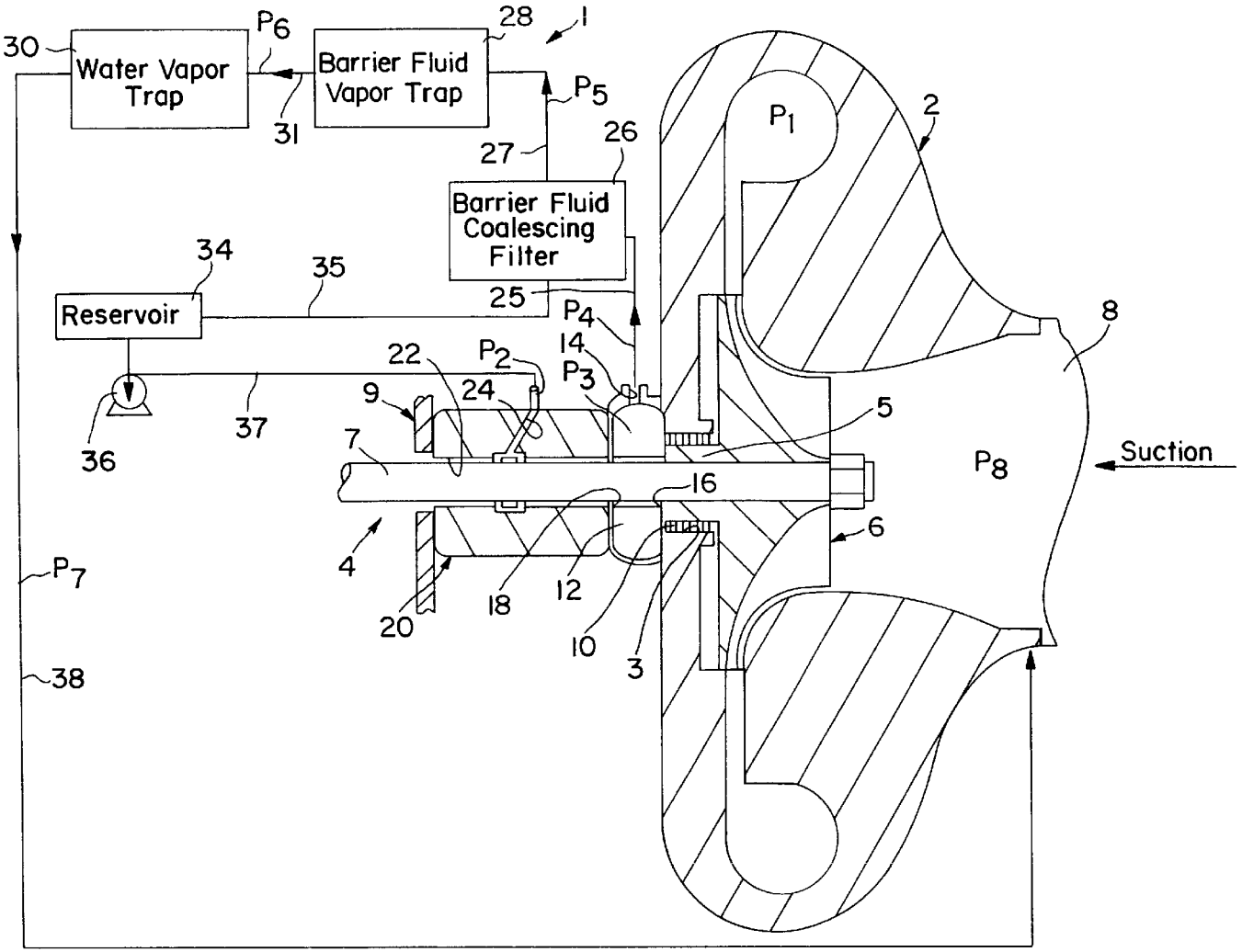
Suction
8
$P_8$
2
$P_1$
5
6
16
3
10
12
18
20
4
7
9
22
24
$P_2$
14
$P_3$
$P_4$
25
26
Barrier Fluid Coalescing Filter
27
$P_5$
1
28
Barrier Fluid Vapor Trap
31
$P_6$
Water Vapor Trap
30
35
34
Reservoir
36
37
$P_7$
38

SEALING SYSTEM

FIELD OF THE INVENTION

The present invention relates to a sealing system to prevent loss of fluid from an opening of a device through which a rotating member projects. More particularly, the present invention relates to such a sealing system in which the opening is sealed by a rotary shaft seal, a chamber receives any fluid leakage from the shaft seal, and a barrier seal prevents leakage of fluid from the chamber. Even more particularly, the present invention relates to such a sealing system in which barrier fluid is separated from the fluid so that the fluid is able to be returned to the device.

BACKGROUND OF THE INVENTION

The prior art has provided numerous examples of sealing systems to prevent loss of process fluids from escaping from the interior of devices employing rotating shafts. As may be appreciated, the problem of leakage of process fluid is particularly exacerbated in devices such as compressors that operate at a higher pressure than their surroundings. Refrigerant leakage from a compressor of a refrigeration system can be particularly troublesome where the refrigerant is toxic or potentially destructive to the environment. In mixed gas refrigerant systems, although the refrigerant is not toxic, any leakage from the compressor will change the composition of the refrigerant because the constituents of a mixed gas refrigerant will leak in unequal amounts due to their different properties. Furthermore, the components of mixed gas refrigerants are expensive and any loss of refrigerant is a significant cost penalty to the process.

In the prior art, compressor assemblies for refrigeration systems are provided with integrated, compressors, motors and gear boxes. Refrigerant leaking from the compressor into the gear box is separated from gear oil contained in the gear box and drawn back into the suction side of the compressor. The gear box may be either hermetically sealed or vented.

An example of a sealed gear box is disclosed in U.S. Pat. No. 6,018,962. In this patent, the compressor assembly is housed in an air tight enclosure. Refrigerant leaking into the gear box mixes with gear oil and a mixture of refrigerant and gear oil collects in a sump of the gear box. The mixture is drawn through a demister element to separate the gear oil from the mixture under suction provided by the low pressure side of the compressor. The suction further draws the refrigerant from the demister element back to the low pressure side of the compressor.

U.S. Pat. No. 4,213,307 is an example of a compressor assembly having a gear box vented to a coalescing filter. The coalescing filter separates the refrigerant leakage from the gear oil. The gear oil, after separation from the refrigerant, is pumped back into a sump of the gear box by a jet pump. The refrigerant is drawn from the coalescing filter back to the low pressure side of the compressor. A separate oil pump is used to pump oil to bearings contained within the gear box and also to supply pressurized oil as a motive fluid to the jet pump.

The type of compressor assemblies, discussed above, have purpose-built enclosures and therefore, are not very applicable to large-scale installations in which the components are each provided with an enclosure and the components are separately installed on site. As will be discussed, the present invention provides a sealing system to seal a rotating shaft in which very little modification of the device to be sealed is returned and therefore, the system is applicable to both large and small-scale installations.

SUMMARY OF THE INVENTION

The present invention provides a sealing system to prevent loss of a process fluid from a device having a device opening and a rotating member operable for rotational movement within the device opening. The sealing system is provided with a rotary shaft seal to provide a seal between the rotating member and the device opening, thereby to inhibit leakage of the process fluid from the device. A chamber is connected to the device and aligned with the rotary shaft seal to recover leakage of the process fluid from the rotary shaft seal. In this regard, the term "connected" as used herein and in the claims encompasses both an integral formation such as with the housing of the device or other component and external connections of various types such as by welding. The chamber has an outlet port and opposed inner and outer openings to allow the rotating member to project through the chamber. A barrier seal is connected to the chamber, adjacent to the outer opening thereof. The barrier seal is provided with a bore to receive the rotating member and in inlet port in communication with the bore to inject a barrier fluid under pressure to prevent the escape of the process fluid from the outer opening of the chamber. Thus, the chamber also receives barrier fluid through the outer opening. At least one filter is in communication with the outlet port of the chamber to separate the barrier fluid from said process fluid. A return passageway is in communication with the at least one filter and is in communication with the device to return the process fluid to the device.

The device may be a compressor to compress the process fluid from an inlet pressure to an outlet pressure higher than that of an inlet pressure. The compressor is provided with an inlet section for receiving the process fluid at the inlet pressure and the return passageway is in communication with compressor so as to return the process fluid to the inlet section of the compressor. The compressor may be of the type that has an impeller to compress the process fluid entering the compressor from the inlet section. The rotating member of such a compressor may be an enlarged, cylindrical base element of an impeller, the cylindrical base element being located within the device opening, and a drive shaft element, projecting through the enlarged, cylindrical base element. The drive shaft element is connected to the impeller and extends through the barrier seal and the outer and inner openings of the chamber.

In any application of the present invention, the rotary shaft seal can be a labyrinth seal.

In the present invention, the barrier fluid can be a liquid upon introduction to the inlet port of the barrier seal thereby to produce within the chamber a mixture containing the liquid and a vapor comprising the process fluid. The at least one filter can therefore be a coalescing filter to coalesce the liquid from the mixture. The vapor of the mixture can also comprise barrier fluid vapor and a barrier fluid vapor trap can be interposed between the return passageway and the coalescing filter to separate the barrier fluid vapor from the vapor of the mixture. Additionally, the vapor of the mixture can further comprise water vapor and a water vapor trap can be interposed between the barrier fluid vapor trap and the return line to separate any water vapor from the vapor of the mixture.

In an application of the present invention to a compressor, the compressor can have a gear box from which the rotating member is driven. The barrier fluid can be gear oil to provide lubrication within the gear box and the bore of the barrier seal can be in communication with the gear box, opposite to the chamber, such that gear oil from the bore, at one end thereof, flows into the gear box.

In a sealing system of the present invention, a reservoir can be in communication with the coalescing filter to receive the separated barrier fluid liquid. A pump can be located between the reservoir and the inlet port of the barrier seal to pressurize the liquid.

The sealing system of the present invention can be applied to a compressor of a refrigeration system and the process fluid to be compressed can be a refrigerant. The refrigerant can be a mixed gas refrigerant.

As has been described above, the present invention provides a leak proof system in which a rotary shaft seal such as a conventional labyrinth seal is used in combination with a barrier seal, a filter and, when required, an adsorbent trap for water. The small amount of process fluid that will pass through the rotary shaft seal and mix with the barrier fluid is recovered and separated. The barrier fluid is returned to its reservoir and the process fluid is then transferred to an adsorbent bed where the refrigerant is dried, if necessary. The process fluid is then returned to the device without loss.

Since there is no loss in the system, no make-up of the barrier fluid is required. Also no auxiliary pumps are required by the system to return the captured refrigerant to the process. There is no specific type of enclosure required and the enclosures need not be integrated. As such, the present invention is applicable to large-scale installations. However, even in smaller installations, the elimination of the need for a specific integrated enclosure eases the complexity of maintenance operations for the compressor.

BRIEF DESCRIPTION OF THE DRAWINGS

While the specification concludes with claims distinctly pointing out the subject matter that the Applicants regard as their invention, it is believed that the invention will be better understood from the sole FIGURE which is a schematic of a sealing system in accordance with the present invention.

DETAILED DESCRIPTION

With reference to the sole FIGURE, a sealing system 1 is provided to prevent loss of a process fluid from a device which for exemplary purposes is a compressor 2 having a device opening 3 and a rotating member 4 operable for rotational movement within device opening 3.

Rotating member 4 is made up of an enlarged, cylindrical base element 5 of an impeller 6 and a drive shaft 7 projecting through enlarged, cylindrical base element 5 and connected to impeller 6. Compressor 2 acts to compress a process fluid from an inlet section 8 thereof by action of impeller 6.

Sealing system 1 acts to capture process fluid leakage from device opening 3 and return the same to an inlet section 8 of compressor 2. The process fluid for compressor 2 can be a mixed gas refrigerant made up of, for example, about 20% nitrogen, about 15% argon, about 25% carbontetrafluoride, about 25% pentabromoethane and about 15% perfluoropropanolmethylether.

It is to be noted that compressor 2 is illustrated for exemplary purposes and the present invention in its broader aspects has application to other devices, other refrigerants and process fluids. In this regard, rotating member 4 could be any cylindrical element operable for rotation within a device opening.

Sealing system 1 includes a labyrinth seal 10 or other suitable rotary shaft seal to provide a seal between rotating member 4 and device opening 3 to inhibit leakage of the mixed gas refrigerant from compressor 2. During operation, compressor 2 produces a pressure P, that is higher than ambient pressure and thus acts to drive the mixed gas refrigerant through labyrinth seal 10. A typical labyrinth seal is a Type 905 that can be obtained from Qualiseal Technology Div. of Quality Control Corporation of 7319 West Wilson Avenue, Harwood Heights, Ill. 60706. Normal leakage through the labyrinth seal with be in a range of between about 1% and about 5% of the flow through compressor 2. When compressor 2 is not operating, no pressure is produced within compressor 2 and barrier seal 20 provides a positive seal against the stationary, shaft 7 to prevent the loss of any refrigerant.

A chamber 12 is connected to compressor 2 and aligned with rotary shaft seal 10 to recover leakage of the mixed gas refrigerant from rotary shaft seal 10. As illustrated, chamber 12 is an integrally formed component of the housing of compressor 2. As mentioned above, chamber 12 in a proper embodiment of the present invention, could be externally attached to such housing by such connection technique as welding. Chamber 12 is provided with an outlet port 14 and opposed inner and outer openings, 16 and 18 to allow drive shaft 7 of rotary member 4 to project through chamber 12.

A barrier seal 20 is connected to chamber 12 adjacent to outer opening 18 thereof. Barrier seal 20 has a bore 22 to receive drive shaft 7 and an inlet port 24 in communication with bore 22 to inject a barrier fluid under pressure to prevent the escape of the mixed gas refrigerant from outer opening 18 of chamber 12. The pressure of the barrier fluid, P2, is slightly higher than pressure P3 the vapor pressure of the mixed gas refrigerant within chamber 12. As a result, chamber 12 also receives barrier fluid through outer opening 18. A typical barrier seal is a TURBOPAC Type 368 barrier seal that can be obtained from Flowserve Corporation of 4615 Southwest Freeway, Houston, Tex. 77027.

In the illustrated embodiment, the barrier fluid can be a gear oil used for gear box lubrication purposes. Such gear oil could be a polyalphaolefin having a composition given by the formula $(C_{10}H_{22})_x$, where x has the values of 1, 1.5, 2, 2.5 . . . 8. Other barrier fluids are possible. Preferably, the barrier fluid should be immiscible with the refrigerant, have a low vapor pressure, and a low solubility in the barrier fluid.

Within chamber 12, a mixture of the barrier fluid and the mixed gas refrigerant is produced in the form of a mist containing fine droplets of the barrier fluid and a vapor composed of the mixed gas refrigerant and barrier fluid vapor. It is to be noted that the composition of the vapor produced within chamber 12 will depend upon the vapor pressure of the barrier fluid and therefore, barrier fluids having a very low vapor pressure will have a very low partial pressure with respect to the mixture produced within chamber 12.

The mixture of the barrier fluid and the mixed gas refrigerant is discharged from outlet port 14 of chamber 12 by a conduit 25 to a filter 26. Filter 26 can consist of one or more filters specifically designed to separate the barrier fluid used from the mixed gas refrigerant or other process fluid of concern. In the case of the illustrated embodiment, filter 26 is a filtering system containing a series of coalescing filters, for instance, a Grade 8 followed by a Grade 6, which is in turn followed by a Grade 2 filter manufactured by Parker Hannifin Corporation, Finite Filter Division of 500 South Glaspie Street, Oxford, Mich. 48371.

A barrier fluid vapor trap 28 is in communication with filter 26 by a conduit 27. Barrier fluid vapor trap 28, which can contain a bed of carbon molecular sieve, is provided to separate any barrier fluid vapor from the vapor of the mixture. Such a vapor trap can be a Grade AU vapor trap obtained from the Parker Hannifin Corporation, Finite Filter Division. It is to be noted, however, that barrier fluids having a sufficiently low vapor pressure will not produce a significant quantity of barrier fluid vapor and therefore, in a proper embodiment, barrier fluid vapor trap 28 might not be included.

An absorbent bed, such as a molecular sieve, alumina, silica gel or the like, can serve as a water vapor trap 30 to separate any water vapor from the vapor of the vapor mixture. Water vapor trap 30 is in communication with barrier fluid vapor trap 28 by a conduit 31. A suitable water vapor trap is a SPORLAN water vapor trap manufactured by Sporlan Valve Company of 206 Lange Drive, Washington, Mo. 63090. There may be systems where there is not water vapor to be removed, thereby eliminating the need for water vapor trap 20.

Barrier fluid separated from the mixed gas refrigerant through filter 26 is returned to a reservoir 34 by a conduit 35 and is pumped via a pump 36, through conduit 37, to inlet passage 24 of barrier seal 20. Although other barrier fluids are possible, as stated above, the barrier fluid in the illustrated embodiment is gear oil that provides lubrication within a gear box 9 from which drive shaft 7 is driven. As such, barrier fluid seal 20 is connected to gear box 9 with bore 22 in communication with gear box 9 at an opening thereof, opposite to chamber 12, such that gear oil from bore 22, at an end thereof, can flow into gear box 9.

The mixed gas refrigerant, after having been separated from the barrier fluid is returned by a passageway provided by a conduit 38 to inlet section 8 of compressor 3. The pressure, $P_4$, downstream of labyrinth seal 10 is sufficient to drive the mixed gas refrigerant through passageway 38 back to inlet section 8 at a higher pressure than the pressure within inlet section 8 even after the pressure drops produced by filter 26, barrier fluid vapor trap 28, and water vapor trap 30. As such, $P_4$ is greater than pressure $P_5$ within conduit 27; $P_5$ is greater than pressure $P_6$ within conduit 31; $P_6$ is greater than pressure $P_7$ within conduit 38; and $P_7$ is greater than pressure $P_8$ at the suction side of compressor 2.

As may be appreciated, in possible applications of the present invention, when sufficient driving pressure, P4, is not available, an additional compressor might be used.

The following table illustrates typical conditions within sealing system 1.

CONDITIONS OF FLUIDS AT INDICATED PRESSURES

| | Pressure PSIG | Temperature (° F.) | Flow wt. % of Suction | *Barrier Fluid Weight Fraction | Moisture Weight Fraction |
|---|---|---|---|---|---|
| $P_1$ | 30 | 160 | 99 | ppb range | ppb range |
| $P_4$ | 18 | 155 | 1 | ppm range | ppb range |
| $P_5$ | 16.5 | 155 | 1 | ppb range | ppb range |
| $P_6$ | 16 | 155 | 1 | ppb range | ppb range |
| $P_7$ | 15.5 | 155 | 1 | ppb range | 0 |
| $P_8$ | 15 | 155 | 100 | ppb range | 0 |

*ppb—Parts Per Billion;
ppm—parts per million

Although the present invention has been described with reference to a preferred embodiment, as will occur to those skilled in the art, numerous changes, additions, and omissions may be made without the departing from the spirit and scope of the present invention.

We claim:

1. A sealing system to prevent loss of a process fluid from a compressor to compress said process fluid from an inlet pressure to an outlet pressure higher than that of an inlet pressure, the compressor having an inlet section for receiving said process fluid at said inlet pressure, a device opening, a rotating member operable for rotational movement within said device opening, and a gear box from which said rotating member is driven, said sealing system comprising:

a rotary shaft seal to provide a seal between said rotating member and said device opening, thereby to inhibit leakage of said process fluid from said device;

a chamber externally connected to said device and aligned with said rotary rotating member seal to recover leakage of said process fluid from said rotary rotating member seal;

the chamber having an outlet port and opposed inner and outer openings to allow said rotating member to project through the chamber:

a barrier seal connected to said chamber, adjacent to said outer opening thereof, and having a bore to receive said rotating member and an inlet port in communication with said bore to inject a barrier fluid under a barrier seal pressure to prevent the escape of the process fluid from the outer opening of said chamber, the chamber thereby also receiving said barrier fluid through said outer opening;

the barrier fluid being made up of lubricating oil providing lubrication within said gear box, the bore of said barrier seal being in communication with said gear box, opposite to said chamber, such that gear oil from said bore, at one end thereof, flows into said gear box;

at least one filter connected to said outlet port of said chamber to separate said barrier fluid from said process fluid; and a return passageway in communication with said at least one filter and connected to said compressor so as to return said process fluid to said inlet section of said compressor.

2. The sealing system of claim 1, wherein:

said compressor has at least one impeller to compress said process fluid entering said compressor from said inlet section; and the rotating member is an enlarged, cylindrical base element of said impeller located within said device opening and a drive shaft element, projecting through said enlarged, cylindrical base element, connected to said impeller, and extending through said barrier seal and said outer and inner openings of said chamber.

3. The sealing system of claim 1 or claim 2, wherein said rotary shaft seal is a labyrinth seal.

4. The sealing system of claim 1 or claim 2, wherein:

said barrier fluid is a liquid upon introduction to said inlet port of said barrier seal thereby to produce within said chamber a mixture containing said liquid and a vapor; and said at least one filter is a coalescing filter to coalesce said liquid from said mixture.

5. The sealing system of claim 4, wherein said vapor of said mixture also comprises barrier fluid vapor and a barrier fluid vapor trap is interposed between said return passage way and said coalescing filter to separate any barrier fluid vapor from said vapor of said mixture.

6. The sealing system of claim 5, wherein said vapor of said mixture further comprises water vapor and a water vapor trap is interposed between said barrier fluid vapor trap and said return line to separate said water vapor from said vapor of said mixture.

7. The sealing system of claim 4, further comprising:

a reservoir connected to said coalescing filter to receive said liquid; and a pump, located between said reservoir and said inlet port of said barrier seal to pressurize said liquid to said barrier seal pressure.

8. The sealing system of claim 1, further comprising:

a reservoir connected to said at least one filter to receive said liquid; and a pump, located between said reservoir and said inlet port of said barrier seal to pressurize said gear oil to said barrier seal pressure.

9. The sealing system of claim 8, wherein said rotary shaft seal is a labyrinth seal.

10. The sealing system of claim 1, wherein said process fluid is a refrigerant.

11. The sealing system of claim 10, wherein said refrigerant is a mixed gas refrigerant.

* * * * *